US005083444A

United States Patent [19]

Eming

[11] Patent Number: 5,083,444

[45] Date of Patent: Jan. 28, 1992

[54] HEAT INSULATING COVER FOR COOLING CONTAINERS

[75] Inventor: Winfried Eming, Rheinbreitbach, Fed. Rep. of Germany

[73] Assignee: GETA Gesellschaft für Energietechnik und - Anwendung mbH, Rheinbreitbach, Fed. Rep. of Germany

[21] Appl. No.: 566,993

[22] Filed: Aug. 13, 1990

[30] Foreign Application Priority Data

Aug. 15, 1989 [DE] Fed. Rep. of Germany ... 8909749[U]

[51] Int. Cl.[5] ..... F25D 41/00

[52] U.S. Cl. ..... 62/440; 62/45; 62/464; 49/171

[58] Field of Search ..... 62/440, 454, 458, 464; 312/114, 116, 236; 49/171, 464; 220/200, 202, 252, 253, 366, 913

[56] References Cited

U.S. PATENT DOCUMENTS

| | | | |
|---|---|---|---|
| 2,557,211 | 6/1951 | Woodland | 220/945 |
| 3,790,243 | 2/1974 | Whorton, III | 312/116 X |
| 4,449,761 | 5/1984 | Davis | 62/252 |

FOREIGN PATENT DOCUMENTS

| | | |
|---|---|---|
| 8327256 | 2/1984 | Fed. Rep. of Germany . |
| 8416430 | 8/1984 | Fed. Rep. of Germany . |
| 7538186 | 12/1975 | France . |

*Primary Examiner*—Albert J. Makay
*Assistant Examiner*—John Sollecito
*Attorney, Agent, or Firm*—Michael J. Striker

[57] ABSTRACT

A heat insulating cover for an upwardly open cooling container, especially deep cooling container, having a cooling chamber, the heat insulating cover comprises a plurality of cover plates arranged to abut against one another to cover the cooling chamber and to be placed on an upper edge of the cooling container, and elements forming in the cover passages for communicating one side of the cover facing toward the cooling chamber with another side of the cover facing toward a surrounding atmosphere.

27 Claims, 5 Drawing Sheets

FIG.1
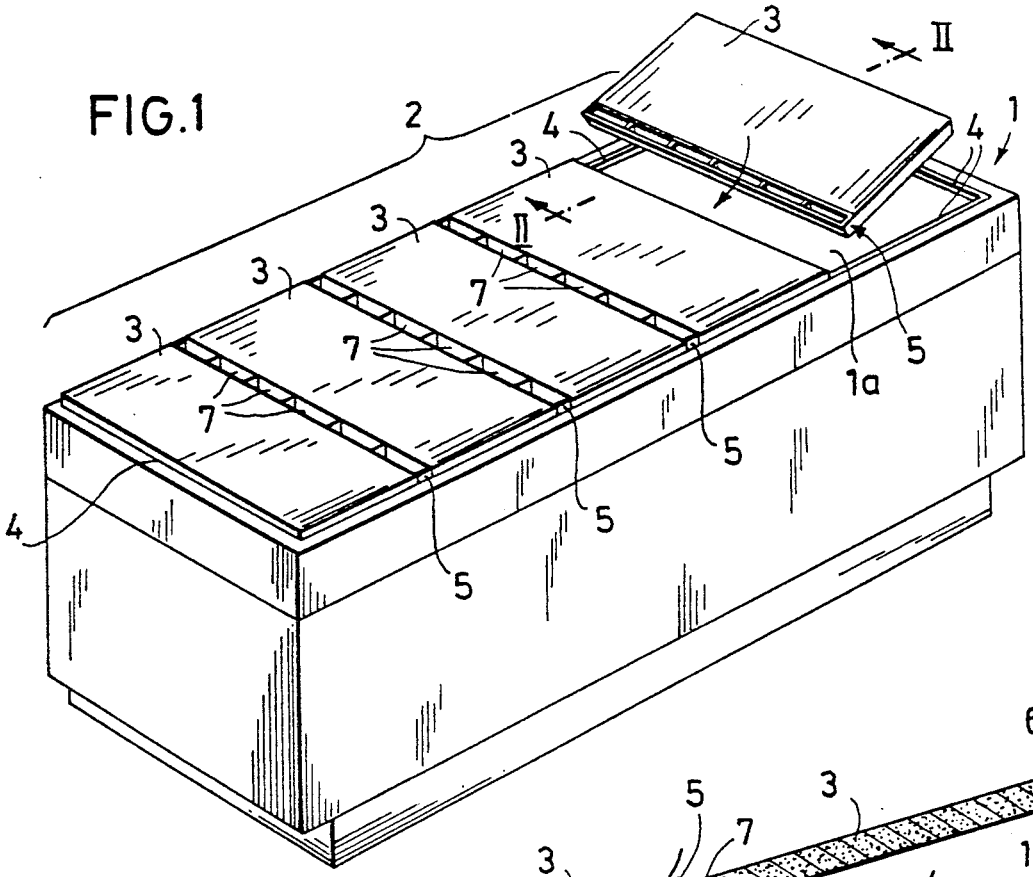
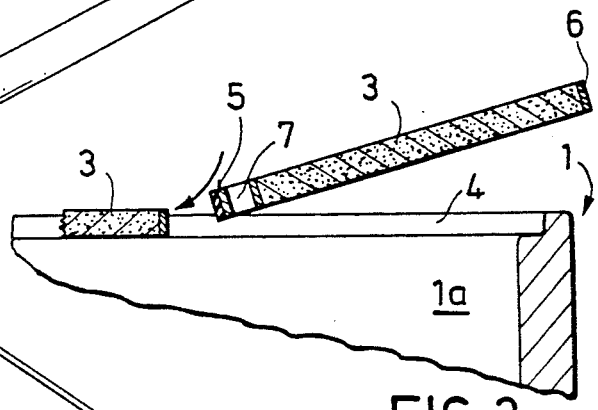
FIG.2
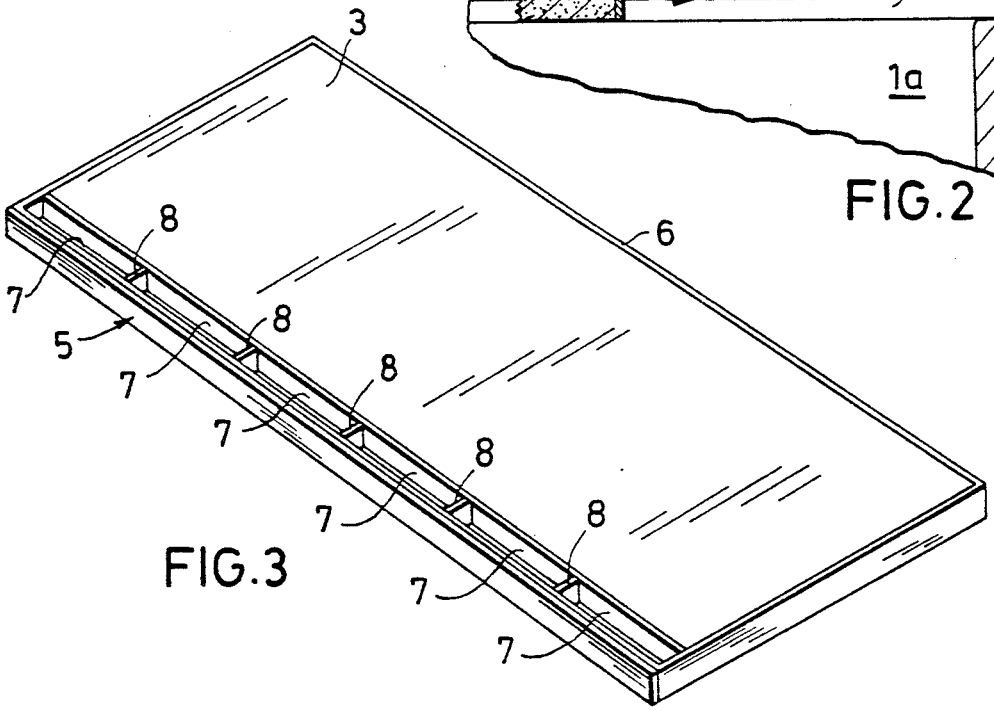
FIG.3

FIG.6
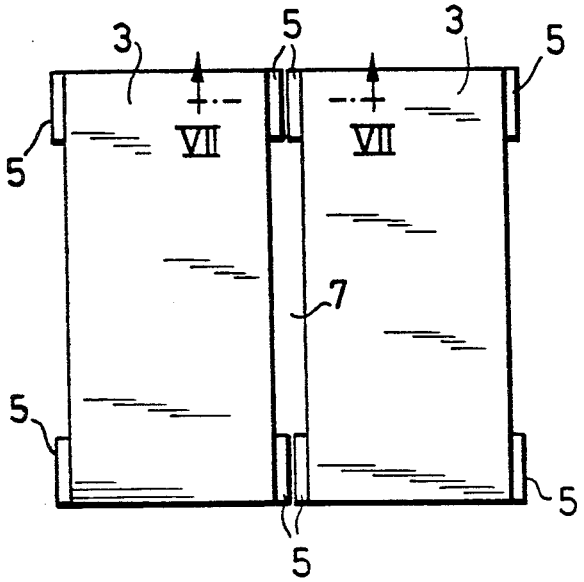
FIG.7
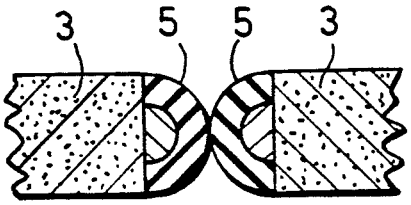
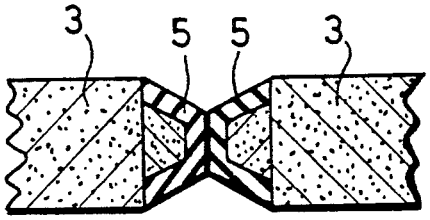
FIG.8
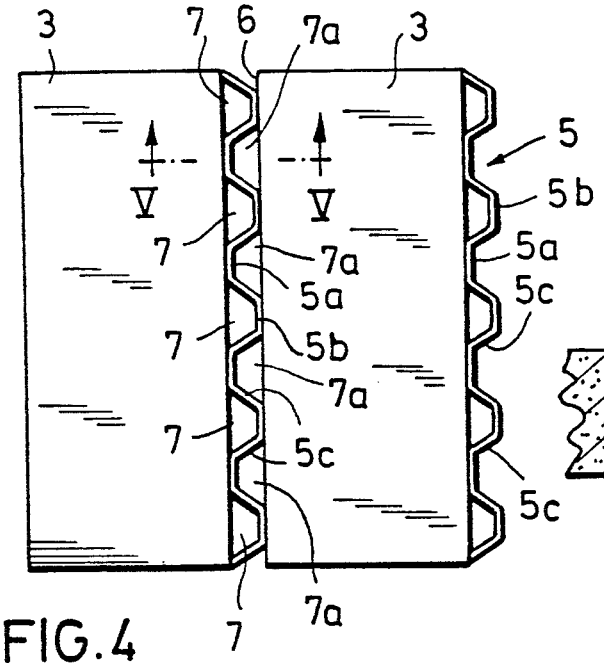
FIG.4
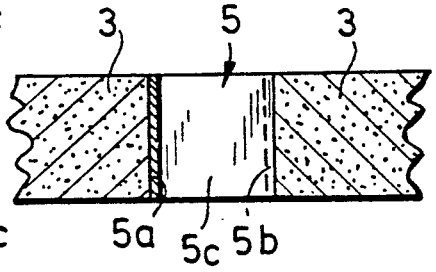
FIG.5

HEAT INSULATING COVER FOR COOLING CONTAINERS

BACKGROUND OF THE INVENTION

The present invention relates to a heat insulating cover on an upwardly open cooling container, especially deep cooling container, with cover plates which cover the cooling chamber, abut against one another, and are placed on the upper edge of the cooling container.

In automatically operating storages cooling containers are used for storing and presenting of food. The food stored in them is maintained at different temperatures, for example up to −21° C. and deeper. Due to the partially high temperature differences relative to the surrounding air and due to the open position of the food the deep cooling containers are characterized first of all by significant cold losses. For avoiding these losses which are very energy expensive and with consideration of a stepped open, not covered goods presentation, the only way to reduce these losses is to close the containers by suitable covers of insulating material during the night. This is conventional in many storages of food institutions.

In order to satisfy the operator of the storage for saving the energy in respective designs of the manufacturer, the cooling containers were provided with closing covers which are generally composed of a thick heat insulating layer of a synthetic plastic foam of several centimeters, with both side coatings of metal or synthetic plastic material, as well as with the corresponding edge trimming for fulfilling the hygiene requirements. These covers abut tightly near one another on the container edge and form an approximately tight surface for good heat insulating properties.

The disadvantage of this cover is that in the gaps between the abutting cover plates air moisture condensates from insides upwardly and forms icicles. When the cover plates are withdrawn individually from the cooling container edges, they fall on the food located underneath. As a result in many storages the night covering is not used to avoid damages to the goods presentation by icicles and similar phenomena.

Moreover, during the operation of such deep cooling containers, the cooling medium evaporator is iced due to the lower operational temperatures. This icing distorts the functions and the operation, and therefore it is required to defrost the evaporator with the use of additional energy and then again restore its operability.

In the deep cooling containers of the known type the moist air in the cooling chamber is circulated during defrosting of the goods to be cooled so that the portion of the moisture in the circulating air in relative short time forms ice on the surfaces of the evaporator.

SUMMARY OF THE INVENTION

Accordingly, it is an object of the present invention to eliminate the disadvantages of the prior art.

More particularly, it is an object of the present invention to eliminate these disadvantages and to form a heat insulating cover so that with high energy saving the formation of icicles, ice pieces and the like, and their separation from the cooling products can be reliably prevented.

In keeping with these objects and with others which will become apparent hereinafter, one feature of the present invention resides, briefly stated, in a cover which is provided with air permeable passages or slots for communicating a cooling chamber with the surrounding air.

When the cover is designed in accordance with the present invention, the cooling air which is circulated in the cooling chamber of the container and the surrounding air of the defrosting process are moved vertically upwardly through the upper cover of the cooling space and particularly through the available air passage openings or slots and removed from the air circulation inside the deep cooling container.

As a result, the ice formation on the cooling aggregates is prevented and the operational time between two defrosting periods is increased. This leads to a significant reduction of energy expenses and increase of the operational safety.

The air passage openings or slots can be formed either in the cover plates or between the cover plates so that the density differences between the moist cooling chamber air and the surrounding air leads to an automatic demoisturization of the air circulating in the cooling chamber.

Since each cover plates has at least one spaces or at least one longitudinal side abutting against the opposite longitudinal side of a neighboring cover plate, the cover plates are no longer supported tight against one another but, for example can be spaced from one another by approximately between 20 and 40 mm, which substantially corresponds to the thickness of such cover plates. This distance leads to an insignificant influence of the heat insulation substantially corresponding to the surface portion occupying by the air passage openings or slots from the total cover surface. They prevent however the condensation of liquid or freezing of air moisture by constant escape of the air moisture available in the cooling chamber and thereby prevent the icicle formation on the cooling aggregates, on the cooled product and on the cover of the cooling chamber.

The spaces can be formed grate shaped with the air passage openings or slots extending perpendicularly to the plane of the cover plate. For example they can be formed of a shaped material with longitudinal webs extending with offset relative to one another in parallel planes relative to the longitudinal side of the respective cover plate. At both ends the longitudinal webs can be connected by the exactly shaped or inclined webs.

Each cover plate at least on both ends can be provided with a spacer on one of its longitudinal sides, so that it abuts either against the longitudinal side of the neighboring cover plate or against the spacer mounted on the longitudinal side of the neighboring cover plate.

The spacers can have a cross-section which is curved outwardly from the longitudinal side of the cover plate, and can be circularly shaped, rectangular, trapezoidal, triangular or the like.

The spacers can also be formed as grips extending outwardly from the longitudinal side of the cover plate, or formed as angular profiled pieces.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a cooling container with a heat insulating cover in accordance with the present invention;

FIG. 2 is a view showing a section taken along the line II—II in in FIG. 1 on an enlarged scale;

FIG. 3 is a perspective view of a cover plate with lateral spacers of FIGS. 1 and 2;

FIG. 4 is a view showing a different embodiment of such cover plates with lateral spacers;

FIG. 5 is a view showing a section taken along the line V—V in FIG. 4, on an enlarged scale, showing two abutting cover plates;

FIG. 6 is a plan view of two further cover plates with the spacers;

FIGS. 7 and 8 are partial sections taken along the line VII—VII in FIG. 6 with two cover plates abutting by their spacers;

DESCRIPTION OF THE PREFERRED EMBODIMENTS

Figure 9:
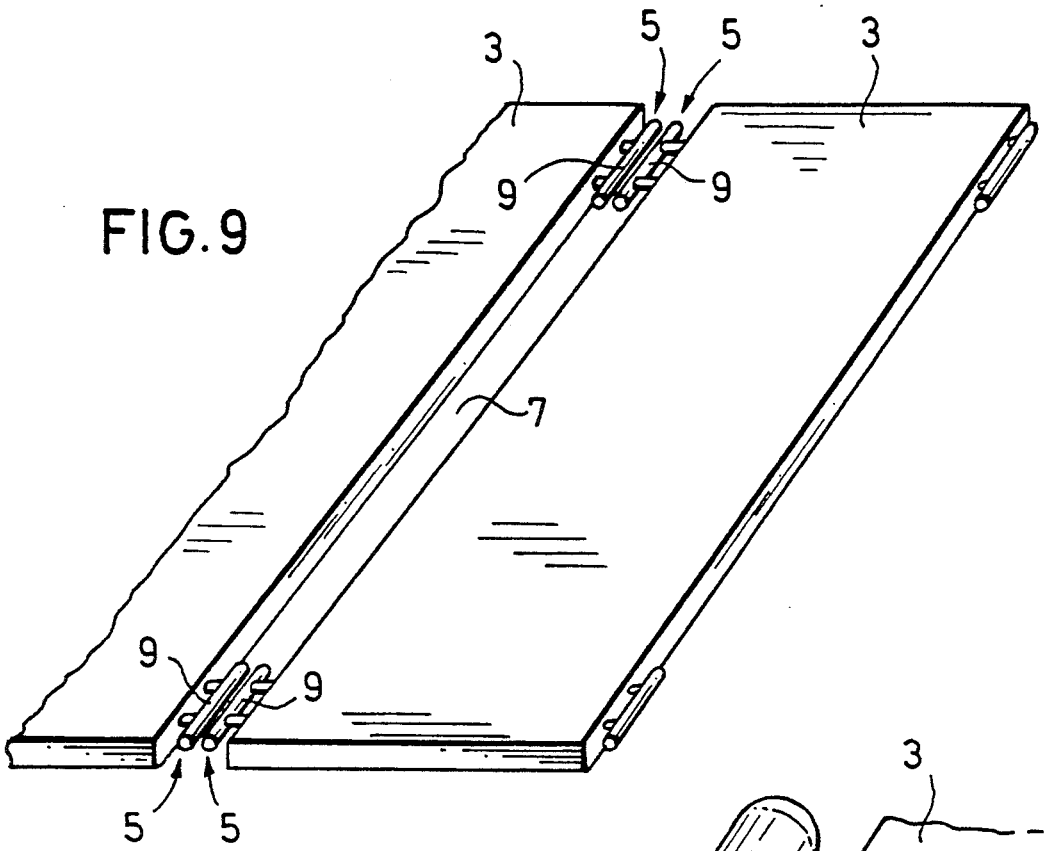
FIG. 9 is a view showing a further embodiment of such cover plates with lateral spacers formed as grips.
Figure 10:
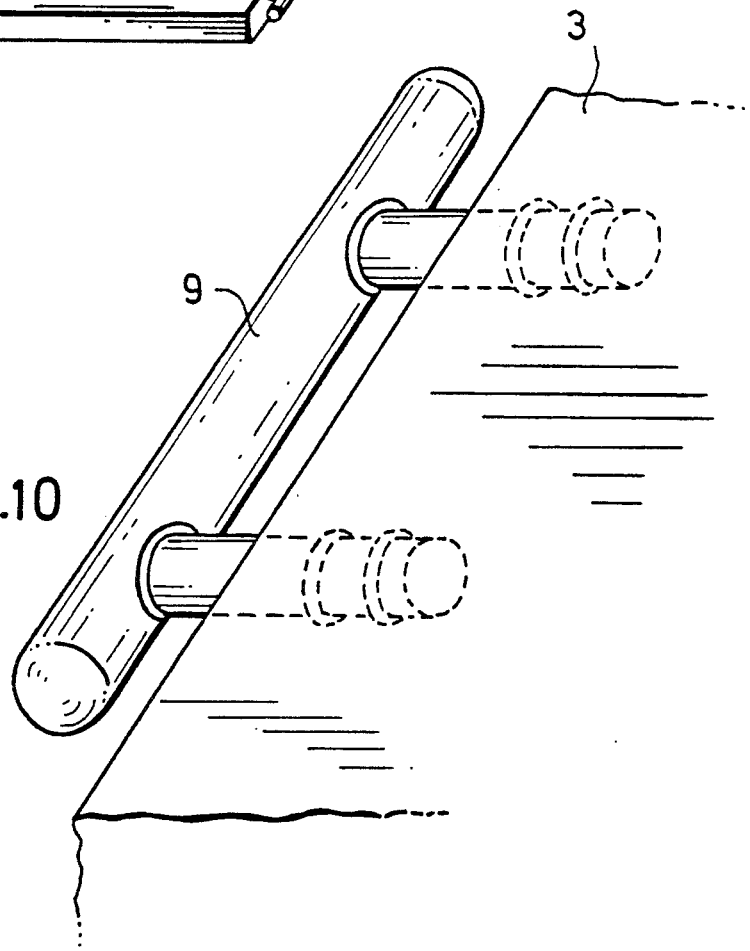
FIG. 10 is a view showing such a spacer on the cover plate of FIG. 9 on an enlarged scale.
Figure 11:
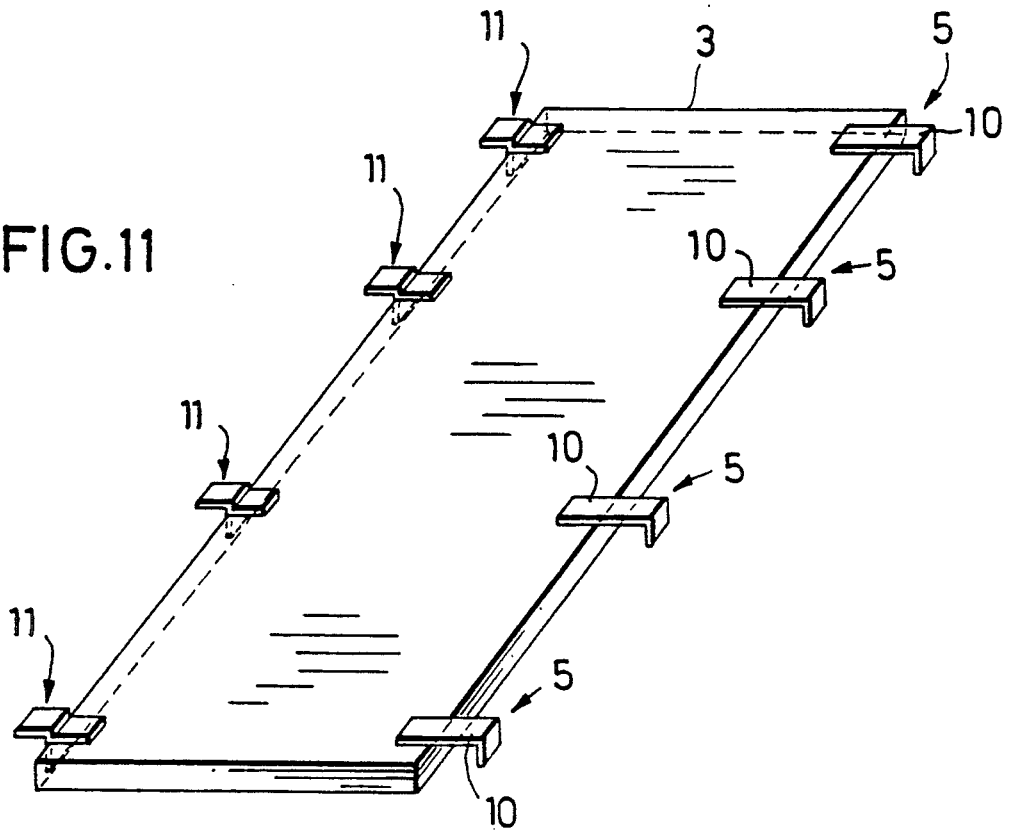
FIG. 11 is a perspective view of a further cover plate with lateral spacers.
Figure 12:
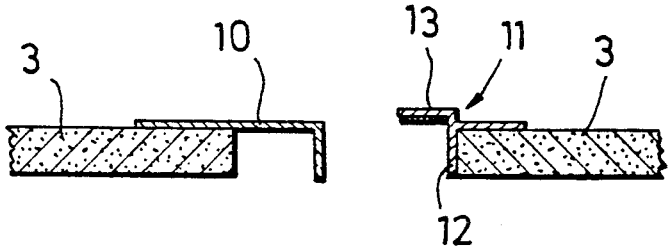
FIG. 12 is a partial section through two such neighboring cover plates with lateral spacers, with engagement of both cover plates.
Figure 13:
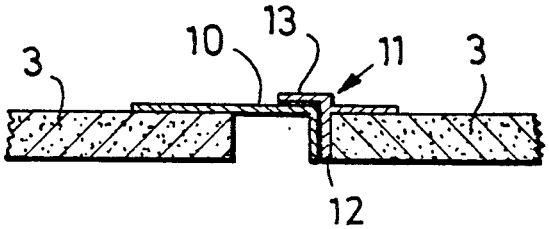
FIG. 13 is a view showing both cover plates abutting against one another by their spacers.
Figure 14:
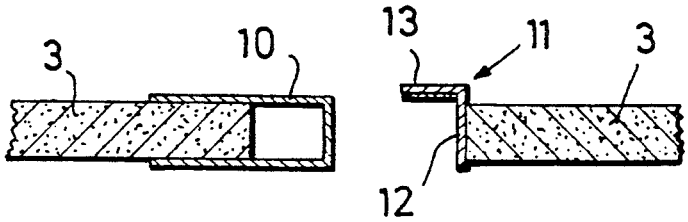
FIG. 14 is a view showing an embodiment which further deviates from the embodiment of FIGS. 11–13, for cover plates provided with lateral spacers.

FIG. 1 shows an upwardly open cooling cabinet 1 which confines a cooling chamber 1*a* and can be formed as a deep cooling cabinet. The cooling cabinet 1 is provided with a heat insulating upper cover 2 which is placed on an upper edge 4 of the cooling cabinet 1 and composed of cover plates 3 abutting against one another. The cover plates 3 can be provided with throughgoing openings or slots 7 for air passage. They communicate the cooling chamber 1*a* with the surrounding air.

Each of the cover plates 3 can be provided with a spacer 5 on its at least one longitudinal side for abutting against the opposite longitudinal side of an adjacent cover plate 3. The spacers 5 can be formed as screens with several air passages or slots 7, extending perpendicular to the plane of the cover plate 3.

In the embodiment shown in FIGS. 1–3 each cover plate 3 of the heat insulating cover 2 has a row of such air openings or slots 7 on one of its longitudinal sides. The air openings or slots 7 are separated from one another by transverse webs 8.

As shown in FIGS. 4 and 5, the spacers 5 can be composed of a profiled material with longitudinal webs 5*a*, 5*b* which are offset relative to one another in two parallel planes relative to the longitudinal side of the cover plate 3. One row of the longitudinal webs 5*a* is mounted on the longitudinal side of cover plate 3. The individual, longitudinal webs 5*a* are fixedly connected on their ends by zigzag-shaped or inclined intermediate webs 5*c* with longitudinal webs 5*b* located in gaps between them.

In this embodiment in addition to the throughgoing openings or slots 7 formed by the zigzag-shaped profile, also throughgoing openings or slots 7*a* are available at the smooth longitudinal side 6 of the neighboring cover plate 3.

As can be seen from FIGS. 6–8, each cover plate 3 can be provided with spacers 5 only at both ends of each longitudinal side. The spacers 5 can abut either against the longitudinal side of a neighboring cover plate 3, or against the spacer 5 mounted on the longitudinal side of the neighboring cover plate.

In the embodiment of the heat insulating cover shown in FIGS. 6 and 7, the spacers 5 have a cross-section which is curved outwardly from the longitudinal side of the cover plate 3. The cross-section of the spacer 5 can be circular. On the other hand, it can be also rectangular, trapezoidal, triangular or similar, as shown for example in FIG. 8.

The spacer 5 can be formed also, as shown in FIG. 9, as a grip 9 which extends outwardly from one longitudinal side or from both longitudinal sides of the cover plate 3. The grips ar arranged at the end of the longitudinal side of the cover plate 3 and abut against one another when the cover plates are arranged in abutment with one another.

Finally, the spacers 5 can be formed as angular-shaped pieces 10 which project outwardly from the longitudinal side in the plane of the cover plate 3. These spacers are shown in FIGS. 11–14.

In addition to the angular profile pieces 10 which extend from the upper side of the cover plate 3 toward the side and are bent outwardly, each cover plate 3, as shown in FIGS. 11–14, can be provided with an angular counter-piece 11 on the longitudinal side which is opposite to the angular profiled pieces 10. The counter-pieces 11 have vertical legs 12 for abutment against the neighboring spacer or against the angular profiled piece 10. It also has a horizontal leg 13 which abuts against the angular profile piece 10 extending laterally on the horizontal of the neighboring cover plate 3 when the cover plates 3 abut against one another. In the embodiment shown in FIG. 14, the angular profiled piece 10 extending laterally has a U-shaped cross-section and thereby is additionally stabilized.

Figure 15:
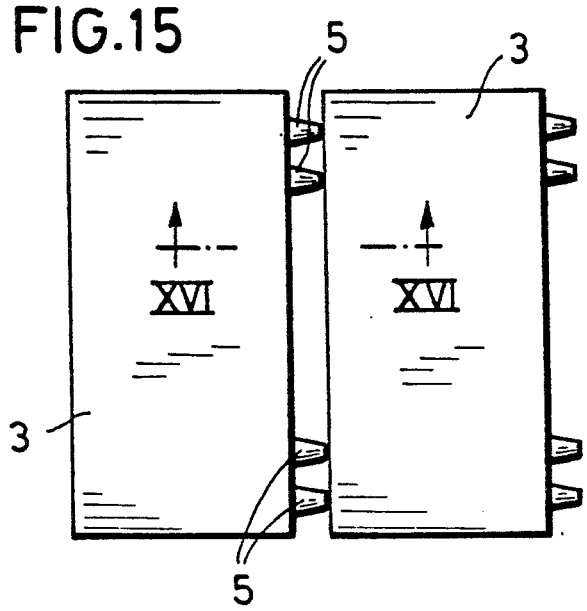
FIG. 15 is a plan of two further cover plates with spacers.
Figure 16:
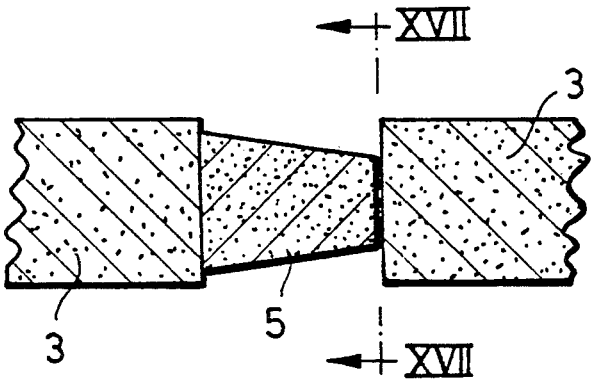
FIG. 16 is a view showing a section taken along the line XVI–XVI in FIG. 15, on an enlarged scale with two abutting cover plates.
Figure 17:
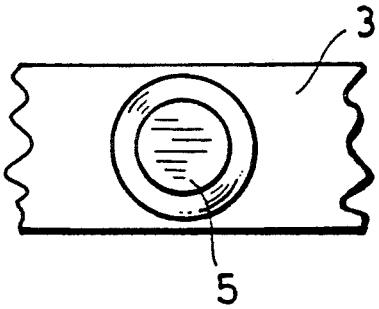
FIG. 17 is a side view in the plane XVII—XVII in FIG. 16, on an enlarged scale.

In correspondence with FIGS. 15–17, the spacer 5 can be formed also as a dull cone, it can be cylindrical or square. Also two, four or more spacers 5 can be provided, so as to extend on one longitudinal side of the cover plate 3 as shown in FIG. 15.

It will be understood that each of the elements described above, or two or more together, may also find a useful application in other types of constructions differing from the types described above.

While the invention has been illustrated and described as embodied in a heating insulating cover, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A heat insulating cover for an upwardly open cooling container, having a cooling chamber, the heat insulating cover comprising a plurality of cover plates arranged to abut against one another to cover the cooling chamber and to be placed on an upper edge of the cooling container; and means for communicating one side of the cover facing toward said cooling chamber with another side of said cover facing toward a surrounding atmosphere, said means for communicating being formed by passages defined by spacers provided in said cover plates.

2. A heat insulating cover as defined in claim 1, wherein said passages are formed as throughgoing openings.

3. A heat insulating cover as defined in claim 1, wherein said passages are formed as slots.

4. A heat insulating cover as defined in claim 1, wherein said passages are formed in said cover plates.

5. A heat insulating cover for an upwardly open cooling container, having a cooling chamber, the heat insulating cover comprising a plurality of cover plates arranged to abut against one another to cover the cooling chamber and to be placed on an upper edge of the cooling container, said cover having passages for communicating one side of the cover facing toward said cooling chamber with another side of said cover facing toward a surrounding atmosphere, said passages being formed in spaces between said cover plates defined by spacers provided in said cover plates.

6. A heat insulating cover as defined in claim 5, wherein each of said cover plates has longitudinal sides and a spacer provided on at least one of said longitudinal sides for abutting against an opposite longitudinal side of a neighboring cover plate so as to form said passages between said cover plates.

7. A heat insulating cover as defined in claim 6, wherein said spacer is grate-shaped and provided with said passages which extend perpendicularly to a plane of said cover plates.

8. A heat insulating cover as defined in claim 6, wherein each of said spacers is composed of a profiled material with longitudinal webs which are offset relative to one another in two parallel plates relative to a longitudinal side of said cover plates.

9. A heat insulating cover as defined in claim 8, wherein each of said spacers has transverse webs provided on its ends and connecting said longitudinal webs with one another.

10. A heat insulating cover as defined in claim 9, wherein said transverse webs ar zigzag-shaped.

11. A heat insulating cover as defined in claim 9, wherein said heat insulating covers are inclined.

12. A heat insulating cover as defined in claim 6, wherein each of said cover plates is provided at both ends of at least one of its longitudinal sides with said spacer.

13. A heat insulating cover as defined in claim 12, wherein said spacers on both ends of said one longitudinal side abut against the longitudinal side of a neighboring one of said cover plates.

14. A heat insulating cover as defined in claim 12, wherein said spacers on both ends of said one longitudinal side abut against a similar spacer provided on an neighboring one of said cover plates.

15. A heat insulating cover as defined in claim 6, wherein said spacer has a cross-section which is outwardly curved from said one longitudinal side of said cover plate.

16. A heat insulating cover as defined in claim 6, wherein said space has a circular arcuate shape.

17. A heat insulating cover as defined in claim 6, wherein said spacer has a rectangular shape.

18. A heat insulating cover as defined in claim 6, wherein said spacer has a trapezoidal shape.

19. A heat insulating cover as defined in claim 6, wherein said spacer has a triangular shape.

20. A heat insulating cover as defined in claim 6, wherein said spacer is formed as a grip which outwardly projects from said longitudinal side of said cover plate.

21. A heat insulating cover as defined in claim 6, wherein said spacer is formed as an angular profiled piece extending outwardly from said longitudinal side of said cover plate in a plane of said cover plate.

22. A heat insulating cover as defined in claim 21, wherein each of said cover plates has an opposite longitudinal side provided with an angular counter-piece having a vertical leg for abutting against a neighboring one of said spacers and a horizontal leg for abutting against said neighboring spacer.

23. A heat insulating cover as defined in claim 6, wherein each of said cover plates has at least one of said spacer at each end of said longitudinal side.

24. A heat insulating cover as defined in claim 6, wherein each of said cover plates has a plurality of said spacers at each end of said longitudinal side.

25. A heat insulating cover as defined in claim 6, wherein said spacer is formed as a cone.

26. A heat insulating cover as defined in claim 6, wherein said spacer is formed as a cylindrical element.

27. A heat insulating cover as defined in claim 6, wherein said spacer is formed as a square element.

* * * * *